US010544977B2

(12) United States Patent
Leslie

(10) Patent No.: US 10,544,977 B2
(45) Date of Patent: Jan. 28, 2020

(54) PORTABLE COOLING SYSTEM

(71) Applicant: Susan Leslie, Los Angeles, CA (US)

(72) Inventor: Susan Leslie, Los Angeles, CA (US)

( * ) Notice: Subject to any disclaimer, the term of this patent is extended or adjusted under 35 U.S.C. 154(b) by 0 days.

(21) Appl. No.: 14/273,229

(22) Filed: May 8, 2014

(65) Prior Publication Data

US 2014/0331714 A1 Nov. 13, 2014

Related U.S. Application Data

(60) Provisional application No. 61/821,103, filed on May 8, 2013.

(51) Int. Cl.
*F25D 3/08* (2006.01)

(52) U.S. Cl.
CPC ..... *F25D 3/08* (2013.01)

(58) Field of Classification Search
CPC ..... F25D 3/08
USPC ..... 62/457.2–457.7, 529, 530
See application file for complete search history.

(56) References Cited

U.S. PATENT DOCUMENTS 4,311,022 A * 1/1982 Hall ..... 62/457.2
4,676,247 A * 6/1987 Van Cleve ..... 607/112
4,892,226 A * 1/1990 Abtahi ..... A45C 11/008 206/204
4,908,248 A * 3/1990 Nakashima et al. ..... 428/35.5
4,923,077 A * 5/1990 Van Iperen et al. ..... 206/527
4,986,089 A * 1/1991 Raab ..... B65D 81/3883 220/903
5,005,374 A * 4/1991 Spitler ..... 62/259.3
5,304,216 A * 4/1994 Wallace ..... A61F 7/0241 607/108
5,934,100 A * 8/1999 Hornick ..... B65D 81/3883 62/371
6,128,915 A * 10/2000 Wagner ..... B65D 81/3883 62/457.3
6,223,551 B1 * 5/2001 Mitchell ..... 62/371
8,424,335 B2 * 4/2013 Corder et al. ..... 62/371
2005/0183446 A1 * 8/2005 Fuchs ..... 62/457.7
2008/0066490 A1 * 3/2008 Santeler ..... 62/530
2014/0311170 A1 * 10/2014 Mills ..... F25D 11/003 62/62

OTHER PUBLICATIONS http://www.amazon.com/Penguins-Reusable-Hinged-Ice-Mat/dp/B00DY4K9U0; Admitted prior art; printed from website on Aug. 20, 2014; 4pp.

* cited by examiner

*Primary Examiner* — Elizabeth J Martin
(74) *Attorney, Agent, or Firm* — Avyno Law P.C.

(57) ABSTRACT

A flat storage ice pack is provided that is designed to effectively wrap around square containers, such as prisma containers. The ice pack is comprised of a container having at least four segments each including a column of freezable liquid. The segments are designed to separate the freezable liquid columns from each other at a distance that will allow the columns, when frozen, to create right angles relative to one another. In this manner, the ice pack is able to sizably fold around a square container by creating corners between the columns for received corresponding corners of square objects, such a prisma containers.

5 Claims, 8 Drawing Sheets

FIG. 3
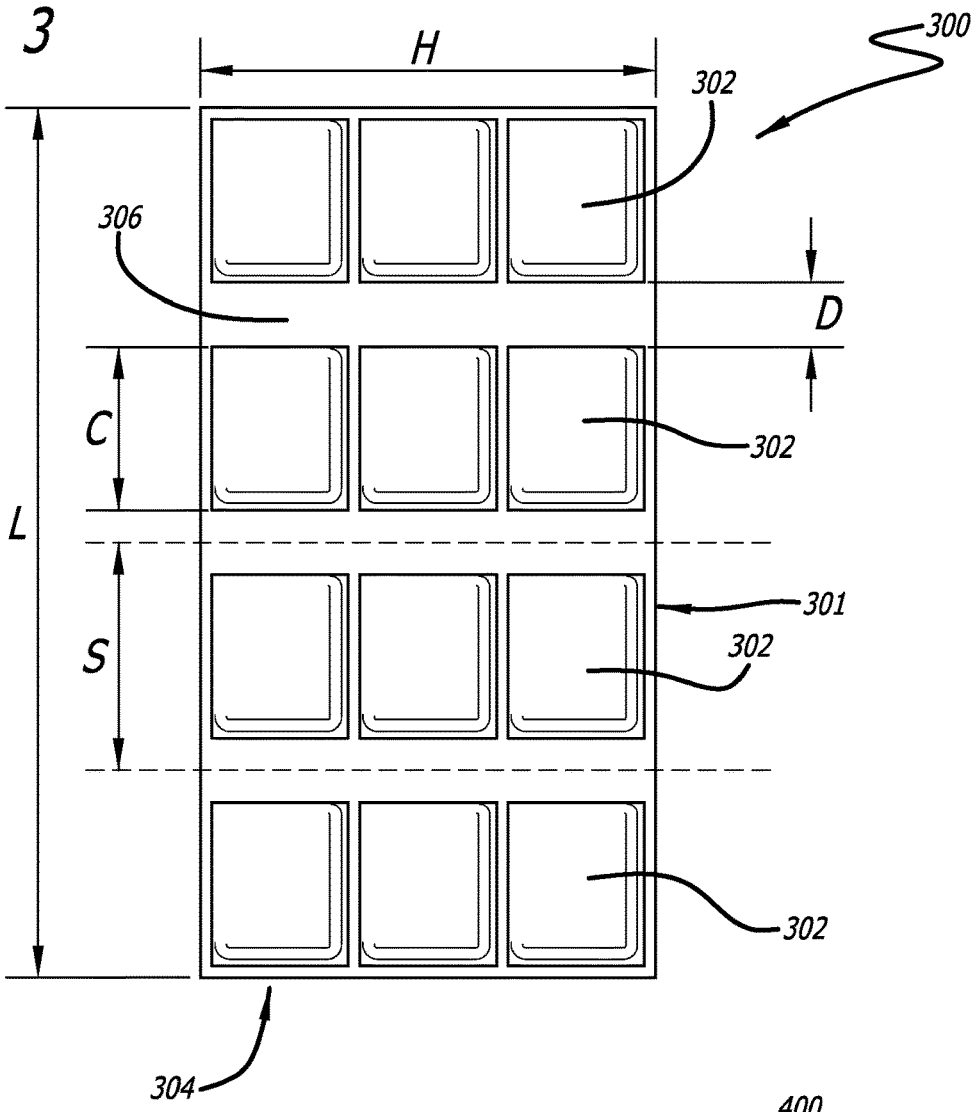
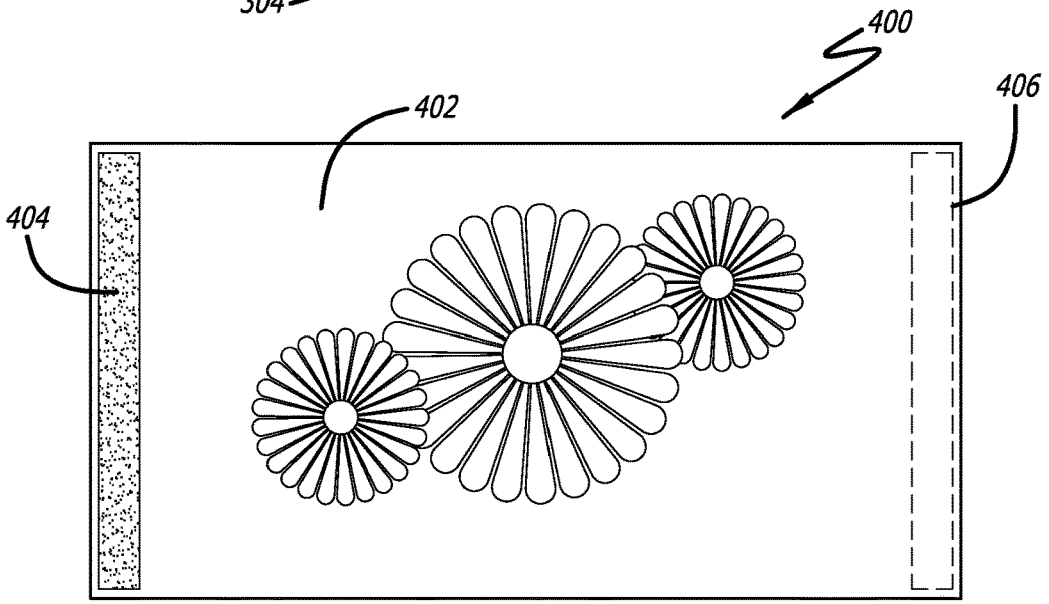
FIG. 4

FIG. 11
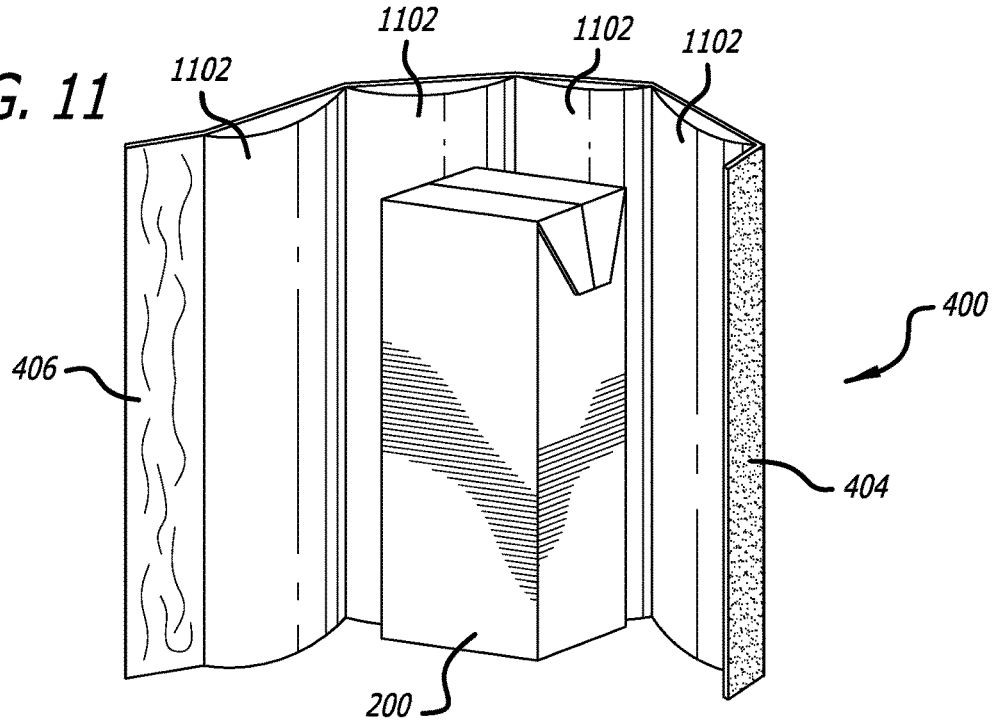
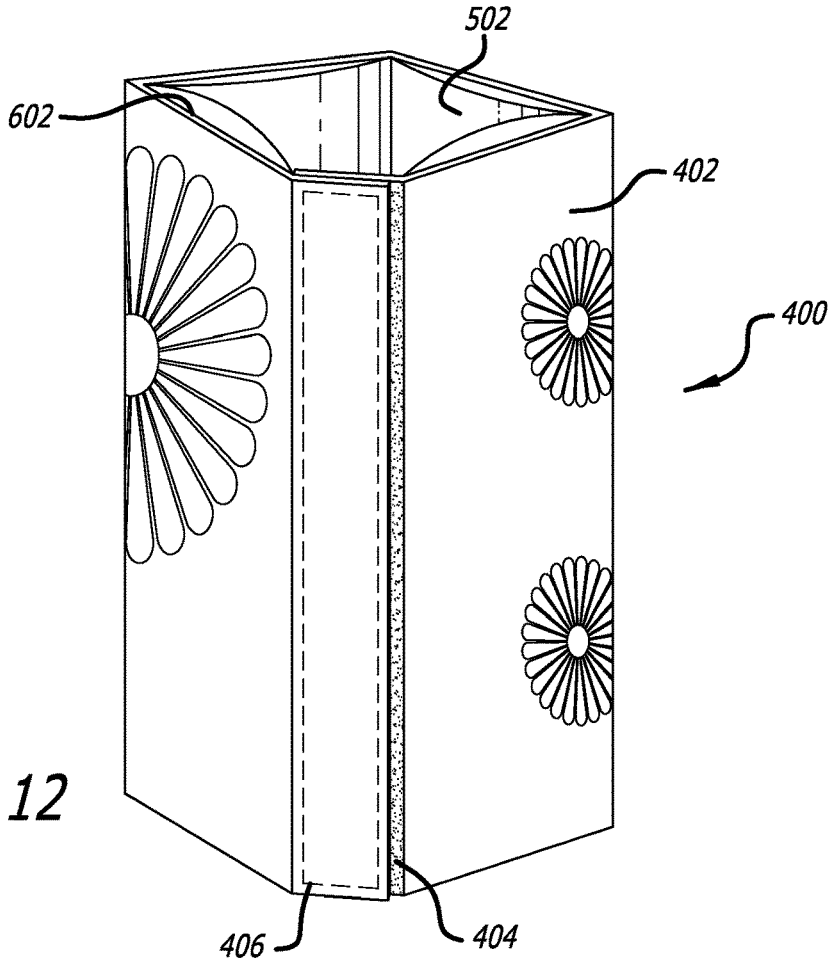
FIG. 12

PORTABLE COOLING SYSTEM

RELATED APPLICATIONS

This application claims priority of U.S. Application Ser. No. 61/821,103, filed on May 8, 2013, titled PORTABLE COOLING SYSTEM, which application is incorporated in its entirety by reference in this application.

BACKGROUND OF THE INVENTION

1. Field of the Invention

The invention relates to a portable cooling system and, in particular, to a cooling system designed to surround a generally rectangular or square item such as a box container.

2. Related Art

Ice packs, such as the ice pack 100 illustrated in FIG. 1 (Prior Art), are common in the marketplace. Ice packs are plastic pouches that contain freezable non-toxic substances such as gel, water, saline, beads, beans, corn or chemical substances. Ice packs are commonly used to treat injuries or to keep food and/or beverages cold for long periods of time. Ice packs used to cool or maintain the temperature of food and beverages are generally sold as flat rectangular re-freezable packs. These re-freezable packs are sized to fit within lunch boxes, food containment systems or compartments therein. Some ice packs, such as the ice pack illustrated in FIG. 1, are sold in dividable cubes with vertically and horizontally positioned heat seals 104 and 106 respectively dividing the freezable substance contained in the plastic pouch into cubes 102. By dividing the freezable substance into cubes 102, the ice packs become more flexible and can be cut along the heat sealed seams 104 and 106 into smaller packs, if desired. These cubed ice packs 100 are approximately 5¾"×7¾" filled and are advertised to have two-inch cubed water pockets 102. While the cubed pockets 102 allow the ice packs 100 to be more flexible, they are not flexible enough to effectively wrap around square objects or smaller objects, such as prisma containers.

Prisma containers 200 such as the ones shown in FIG. 2 (Prior Art) are becoming a more popular means for disseminating fluids for consumption such as milk, juice, wine and the like. While most of the liquids sold in prisma cartons 200 are ones that do not require refrigeration, many people desire to drink the content of prisma cartons 200 cold and only after refrigeration. This is especially true when the cartons 200 contain milk products. As prisma cartons 200 are designed as single serve cartons, they are often individually transported and stored for later consumption. In particular, prisma cartons 200 are especially useful for school lunches; however, maintaining the cartons 200 in a cold state is problematic. Currently, no cold packs exist that are designed to maintain single prisma containers 200 cold for extended periods of time. Accordingly, a need exists for a cold pack that maintains individual prisma cartons in a cold state when outside of the refrigerator.

SUMMARY

A flat storage ice pack is provided that is designed to effectively wrap around square containers, such as prisma containers. The ice pack is comprised of a container having at least four columns of freezable liquid. In one example, the ice pack may be a plastic container having a freezable substance contained therein and separated by heat seals to create columns of freezable substances across the length of the ice pack. The columns are separated from one another at a distance that will allow the columns, when frozen, to bend toward one another and at least create right angles relative to one another. In this manner, the ice pack is able to sizably fold around a square container by creating corners between the columns for received corresponding corners (whether rounded, cropped or squared) of generally square or rectangular objects, such a prisma containers, which the ice packs are intended to maintain a cold temperature.

The ice pack can be positioned inside a pouch that has, at opposing ends, fastening members, such as Velcro, snaps or buttons, for maintaining the ice pack around the square container. The ice pack, alone, or in the container, can further be stored in a flat storage position or can be folded in half for storage or use when not wrapped around a square container.

Alternatively, the ice pack may be a container designed with four separately spaced apart columns designed to receive individual rectangular ice pouches. The ice pouch is individually housed in the separated columns in the ice pack. The columns are designed to maintain a certain distance between the ice pouches to allow the ice pack to wrap around a square object by allowing for the ice pouches to be positioned at right angles relative to one another when frozen.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

FIG. 3 illustrates one example of an ice pack of the present invention having four sized and equally spaced columns of reusable and refreezable refrigerant liquid.

FIG. 4 illustrates one example of a containment sleeve for containing the flat ice pack illustrated in FIG. 3.

FIG. 11 illustrates one example of the containment sleeve having the flat pack ice pack positioned within the sleeve for purposes of wrapping the sleeve around a prisma container.

FIG. 12 is one example of the ice pack of the present invention inside a containment sleeve affixed at its end to surround the prisma container.

DETAILED DESCRIPTION

FIGS. 3-14 illustrate various examples of the portable cooling system of the present invention. As will be illustrated below, the portable cooling system of the present invention may be an ice pack having at least four segments having columns of freezable liquid separated from one another at a distance that allows the ice packs to bend relative to one another at least at right angles, thereby facilitating the wrapping of the ice pack around square objects.

The ice packs can be plastic containers having freezable substances therein separated into at least four columns by heat seals. The ice pack can then be used alone or placed in a containment sleeve that can secure the ice packs around square objects by opposing fasteners. Those skilled in the art will recognize that the ice packs can also take the form of a cloth or plastic container designed with at least four separately spaced apart columns for receiving and maintaining individual rectangular ice pouches. The columns of the container would be spaced apart, separated by, for example, stitching, glue, heat seal or other separating mechanism, such that the container, when housing individual ice pouches therein, would bend relative to one another at least at right angles, thereby also facilitating the wrapping of the ice pack around square objects. The container could include a fastener on at least one end for securing the container around objects. In this example, the container having the ice pouches therein would be considered an ice pack.

Figure 1:
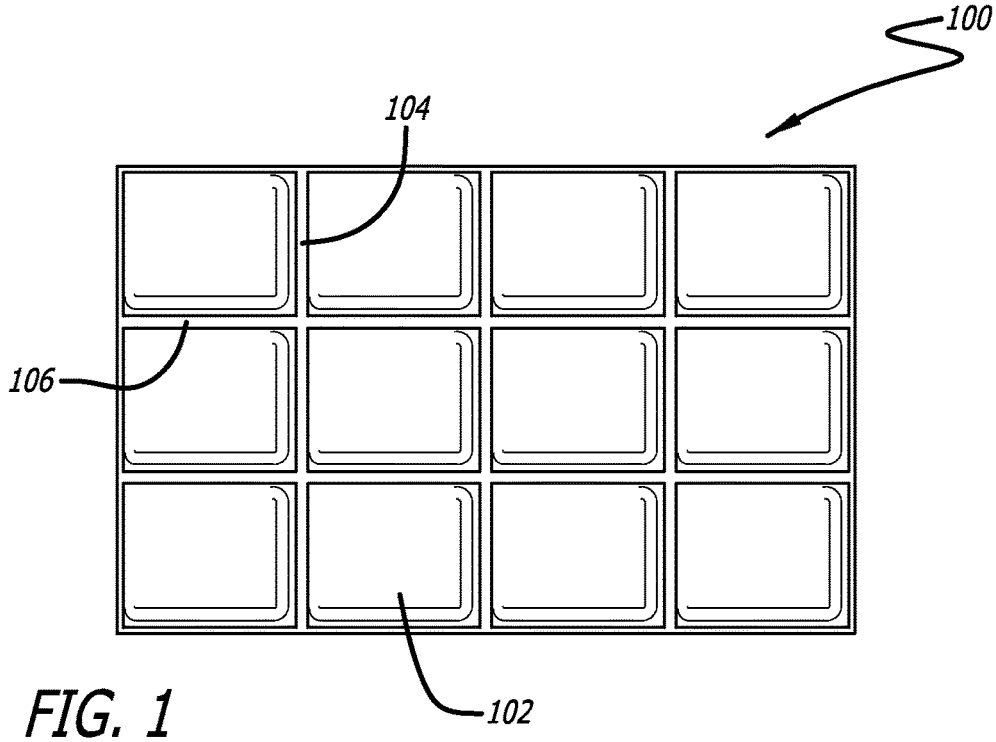
FIG. 1 (Prior Art)
FIG. 1 (Prior Art) illustrates one example of a reusable flat ice pack currently available in the marketplace.
Figure 2:
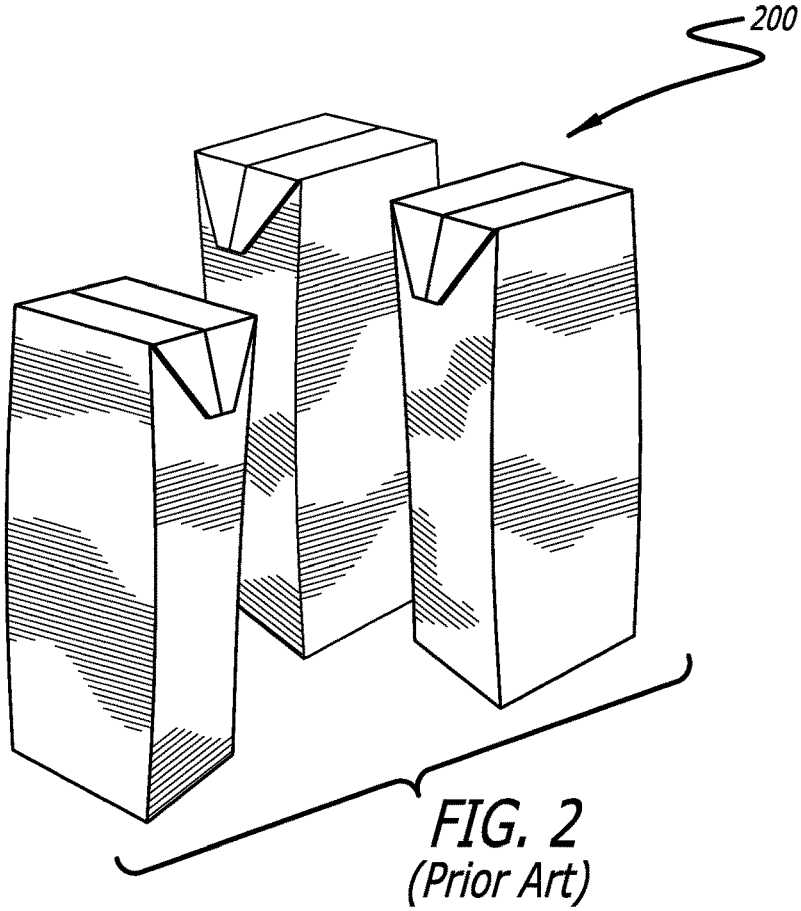
FIG. 2 (Prior Art)
FIG. 2 (Prior Art) illustrates examples of common prisma containers currently available in the marketplace.

As illustrated in FIGS. 3-14, the present invention offers a solution to maintaining square cartons, such as prisma cartons, in a cold state when packed and stored outside of the refrigerator. As noted above, FIG. 2 illustrates common examples of prisma containers 200 that are generally offered for sale in an unrefrigerated state in stores. While the invention is shown in connection with prisma cartons, it is known that other cartons of a similar shape but of varying size may also be maintained in a cold state in accordance with the invention. Further, while the dimensions described below are for an ice pack for use in connection with prisma cartons 200, those skilled in the art will recognize that the dimensions may be scaled upward or downward to accommodate varying sized square objects.

As illustrated in FIG. 3, a flat pack reusable ice pack 300 is provided having at least four segments 301 with columns of freezable substances 302 therein. The columns 302 are separated from one another at a distance to allow the segments 301 containing columns of freezable substance 302 when frozen to form at least right angles relative to one another. In other words, each segment is column 302 separated from one another to allow the flat pack to form a corner capable of receiving a corresponding corner of a square container. The columns may be physically separated, for example, by a heat seal 306.

To accomplish this, each segment 301 is sized to be approximately the width of one side of a square container, such as prisma cartons, for which the ice pack 300 is designed to chill or maintain cold. As the spacing between each column 302 of the ice pack 300 is of a length to allow the segments to form at least right angles relative to one another, the ice pack, whether frozen or unfrozen, will naturally have one segment 301 per side contacting the container when wrapped around the container. Each ice pack segment 301 may be one elongated column of a predetermined width or may be made of multiple sections. The ice pack 300 could be comprised of simply flat plastic segments filled with purified water or other known refrigerant. Preferably, it is suggested that the segments be filled with a fluid safe for children as it likely that the ice packs will be utilized for children's lunches. The ice packs 300 may be sold in a flat pack mechanism with a means for securing the opposing ends of the pack together once wrapped about the containers.

In one example designed for use with prisma containers, the total length of the ice pack 300 may be approximately 9½" in length L and the height H is approximately 5⅝". The width of the segments 301 S are approximately 2⅜-½" and the columns widths C are approximately 1⅝" inches and separated from one another by a distance D of ¾" to ⅞". As noted above, the dimensions described below are for an ice pack for use in connection with prisma cartons 200, those skilled in the art will recognize that the dimensions may be scaled upward or downward to accommodate varying sized square objects.

Figure 5:
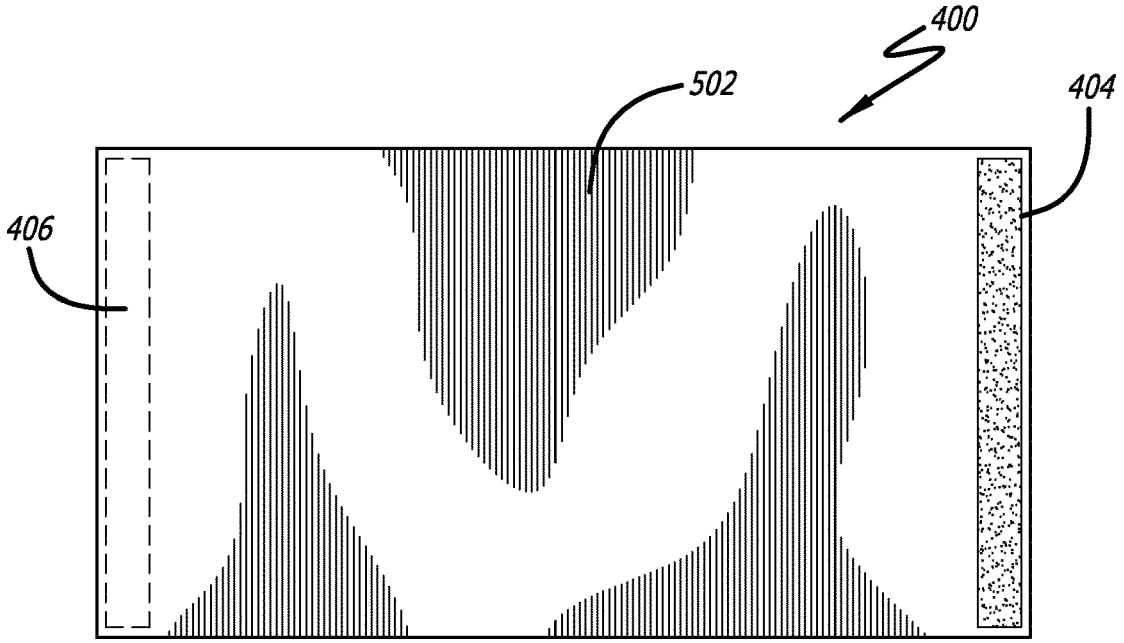
FIG. 5 illustrates one example of the back of a containment sleeve illustrated in FIG. 4.
Figure 6:
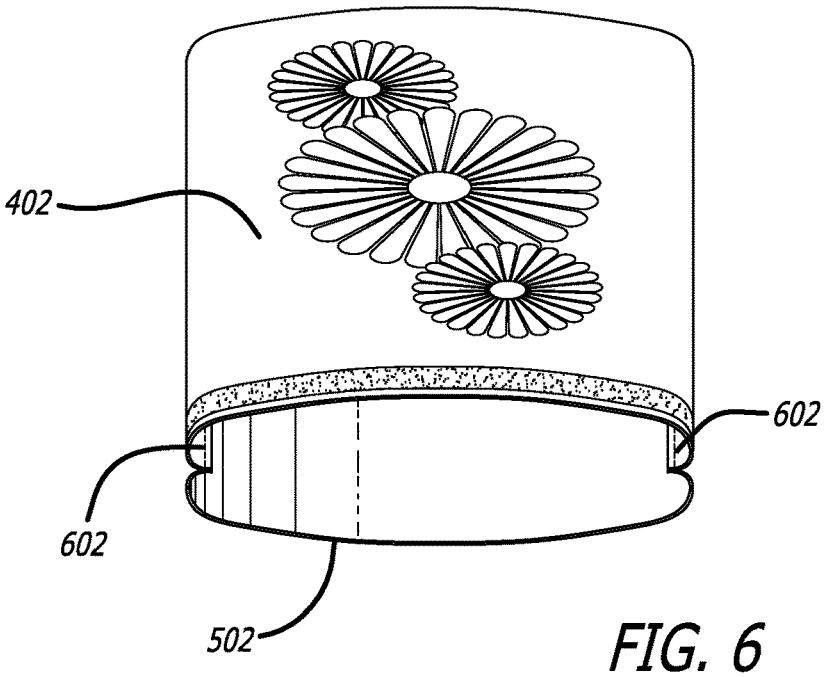
FIG. 6 illustrates the interior of one example of a containment sleeve for containing the flat ice pack of FIG. 3.

Optionally, as illustrated in FIGS. 4-6, the ice packs 300 may be inserted into a containment sleeve 400 that may, for example, be made of a cloth material, insulating material or a combination thereof. The containment sleeve 400 includes a front 402 and back section 502. FIGS. 4, 5 and 6 illustrate one example of a re-sealable cloth containment sleeve for allowing the removal and replacement of the frozen icepacks as illustrated in FIG. 3. The front 402 and back sections 502 may be contiguous or connected together by one or more seams 602. The front and back sections 402 and 502 create an interior compartment capable of receiving the ice packs 300 and sealing the ice packs 300 in the containment sleeve 400 in a permanent or re-sealable manner. In this manner, the ice packs 400 may be frozen and inserted into the containment sleeves when desired to be used. The containment sleeve 400 may include a securing mechanism 404 and 406 for securing the opposing ends of the sleeve 400 about a prisma carton when in use.

As illustrated in FIG. 4, one end of the containment sleeve 400 includes a mechanism for securing one end against the other end when in use. In the example illustrated in FIG. 4, the mechanism 402 and 404 used to secure one end to the other end is Velcro®; however, other securing mechanisms such as buttons, snaps or other adhesives which are re-sealable may be utilized. Further, to hold the icepack 300 in the containment sleeve 400, various securing mechanisms may be utilized to secure the opposing sides of the cloth of the containment sleeve 400 to keep the ice pack 300 within the containment sleeve 400. This may include Velcro®, snaps, re-sealable adhesives, or other re-sealable mechanisms known in the art. Optionally, the ice pack 300 may be permanently contained within the sleeve 400.

Figure 7:
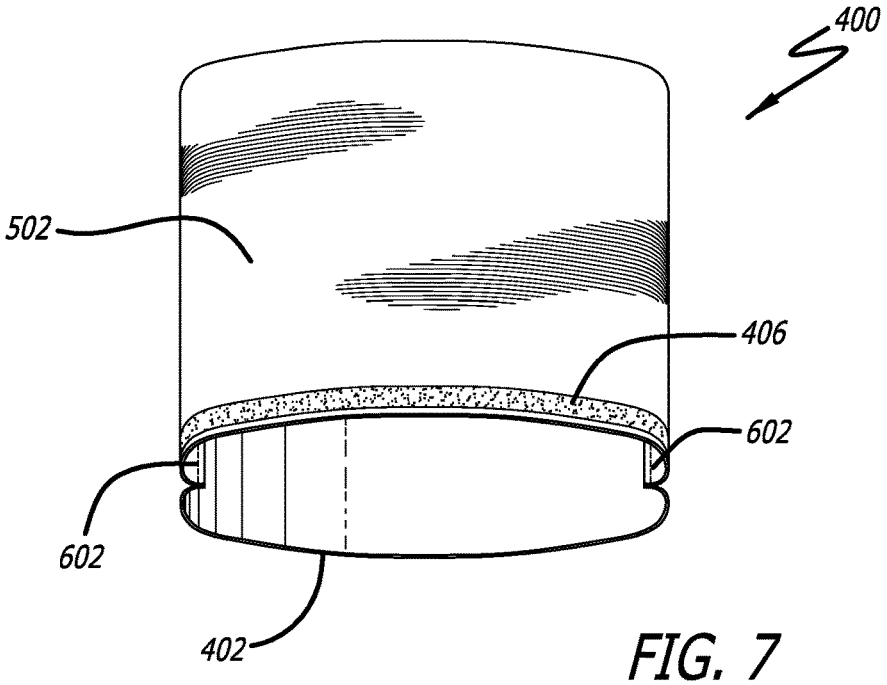
FIG. 7 illustrates a rear perspective view of the interior of the containment sleeve of FIG. 6.

FIGS. 6 & 7 illustrates the interior of the example containment sleeve of FIGS. 4 & 5 for containing the flat ice pack of FIG. 3. As illustrated in FIG. 6, in one example, the containment sleeve may be made from two opposing pieces of material—a top cloth material 402 and a bottom plastic based material 502 to provide insulating properties and generally water impermeability.

Figure 8:
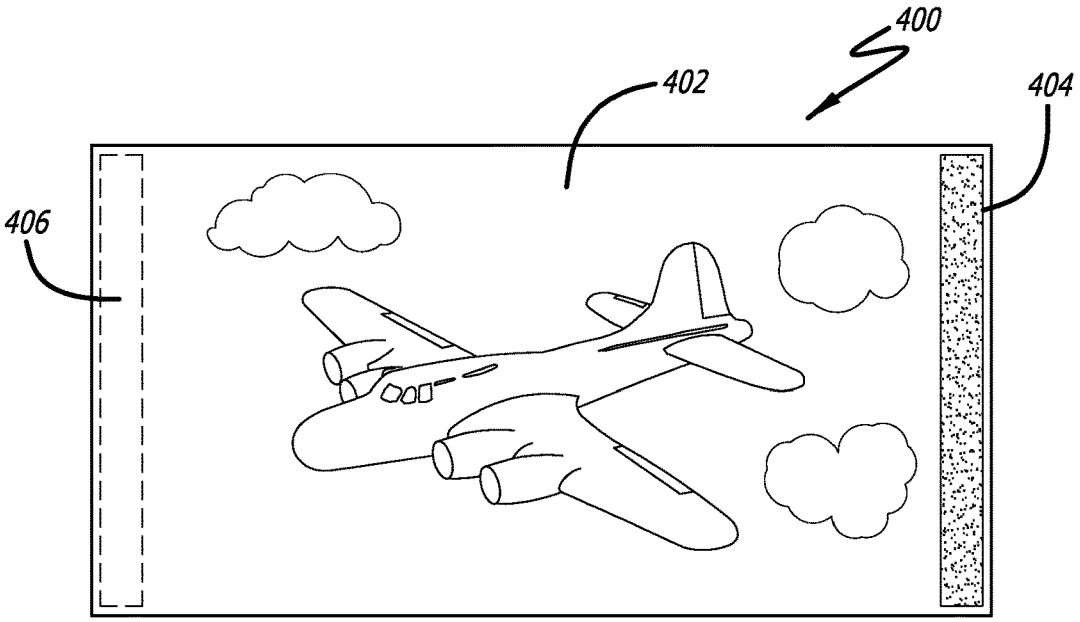
FIG. 8 illustrates another example of a containment sleeve of the present invention having an insulating, water impervious interior layer.

FIG. 8 illustrates another example of the containment sleeve 400 of the present invention. FIG. 8 illustrates the inclusion of a fabric layer on at least one side 402 to impart various designs on at least one side 402 of the containment sleeve 400. FIG. 8 also illustrates opposing Velcro® strips 404 and 406 for securing the sleeve 400 around an object.

Figure 9:
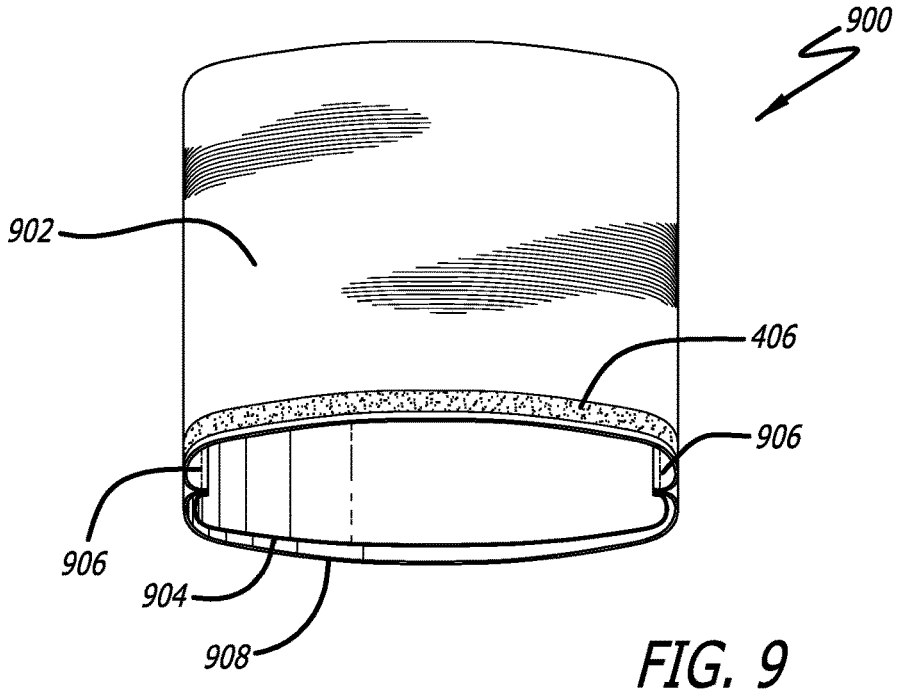
FIG. 9 illustrates another example of a containment sleeve having an inner insulating water impervious layer underneath the fabric layer.
Figure 10:
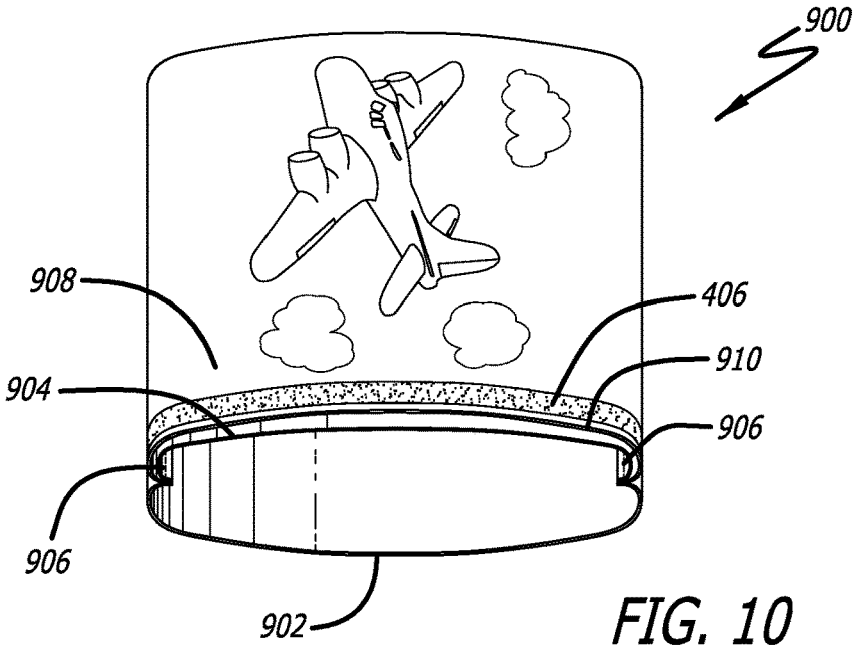
FIG. 10 illustrates another example of an insulated layer as illustrated in FIG. 9, positioned below the decorative fabric layer.

In another example, the containment sleeve 900 may be constructed from three or four pieces of material 902, 904 or 908 such that the ice pack is contained on both sides within a plastic material 902 and 904 and that provides insulation and is generally water impermeable. As illustrated in FIGS. 9 and 10, a third cloth layer 908 may be secured to one side 904 of the containment sleeve 900 to create a decorative layer. This cloth layer, although not shown, can also be placed over the opposing side 902 to create a decorative layer around the entire sleeve 900, if desired. In other words, the sleeve 900 may be made out of plastic or insulating member on the front 902 and back 904 having a decorative covering 908 over at least one side. The decorative covering 908 may be of plain color or of any pattern and may be includes logo or any type of indicia such that the containment sleeve 900 can be targeted to attract varying age groups having varying interests. The sides 902, 904 and 906 may be attached at the respective ends by a seam 906.

As noted above, the containment sleeve 400, 900 may be optional. The containment sleeve may be designed to permanently contain the ice pack of the present invention. If permanently contained, the containment sleeve can act to segment each ice pack column from one another, by for example, having columns in the containment sleeve to receive individual column of reusable and re-freezable ice packs. Alternatively, the ice pack may be designed, as illustrated in FIG. 3, to maintain separation between the segments. Further, the containment sleeve may be made entirely of cloth, entirely of plastic or other insulating material, or any combination of the foregoing.

Figure 13:
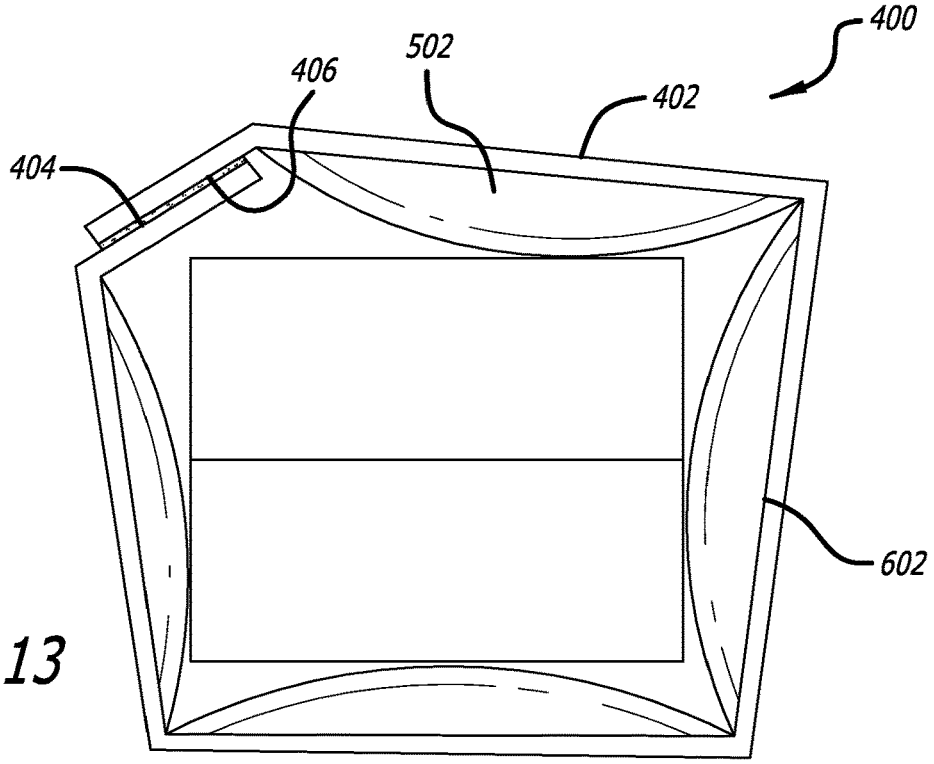
FIG. 13 is a top view of the containment sleeve having an ice pack of the present invention contained therein surrounding a prisma container and affixed at it ends by a securing mechanism.

FIGS. 11-13 illustrates one example of the containment sleeve 400, 900 as used in operation. When in use and when the ice pack 300 is removable from the containment sleeve, the flat ice pack 300, either frozen or unfrozen, may be placed inside the sleeve and securely contained within the sleeve 400, 900. The pack 300 may then be positioned to surround a prisma carton, as illustrated in FIG. 12, and then secured at its ends by a securing mechanism as illustrated in FIG. 13.

As illustrated in FIG. 13, as seen from the top, each side of the columns of the freezer pack may be aligned with one side of the prisma carton in order to provide and maintain the content of the prisma cartoon cool during storage and transportation.

Figure 14:
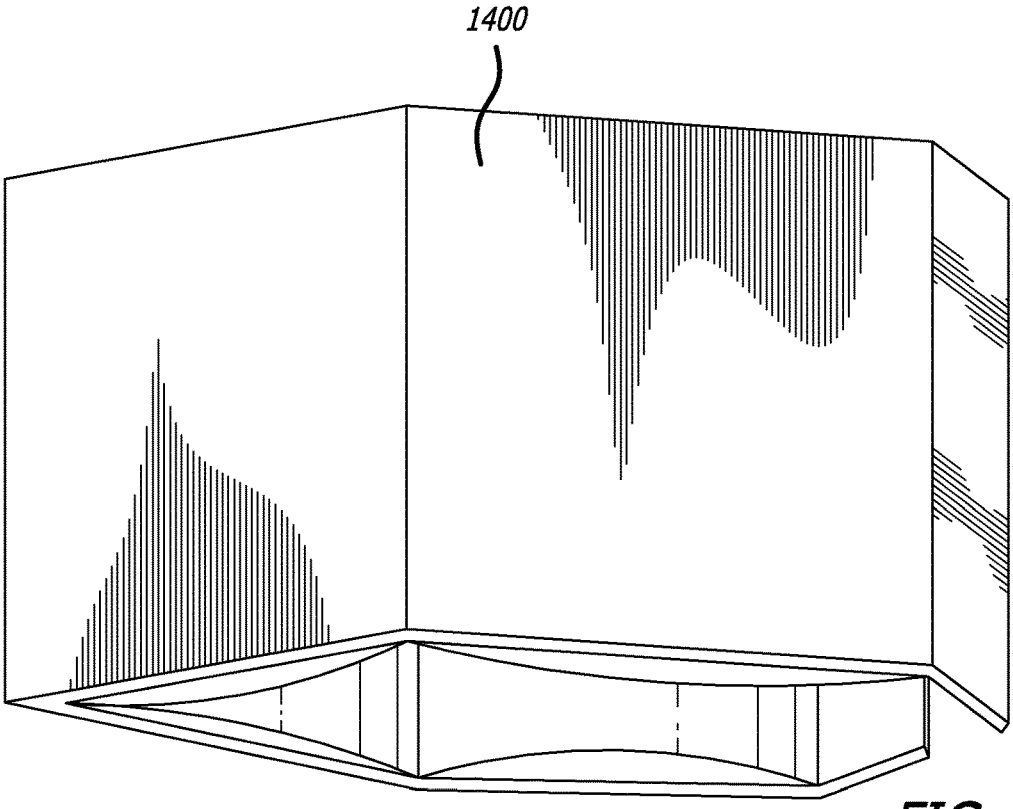
FIG. 14 is a top perspective view of the ice pack of the present invention inside a containment sleeve folded in half to resemble a smaller flat ice pack.

As illustrated in FIG. 14, the ice pack 1400 can also be folded and used similar to a standard flat pack ice pack.

Figure 15:
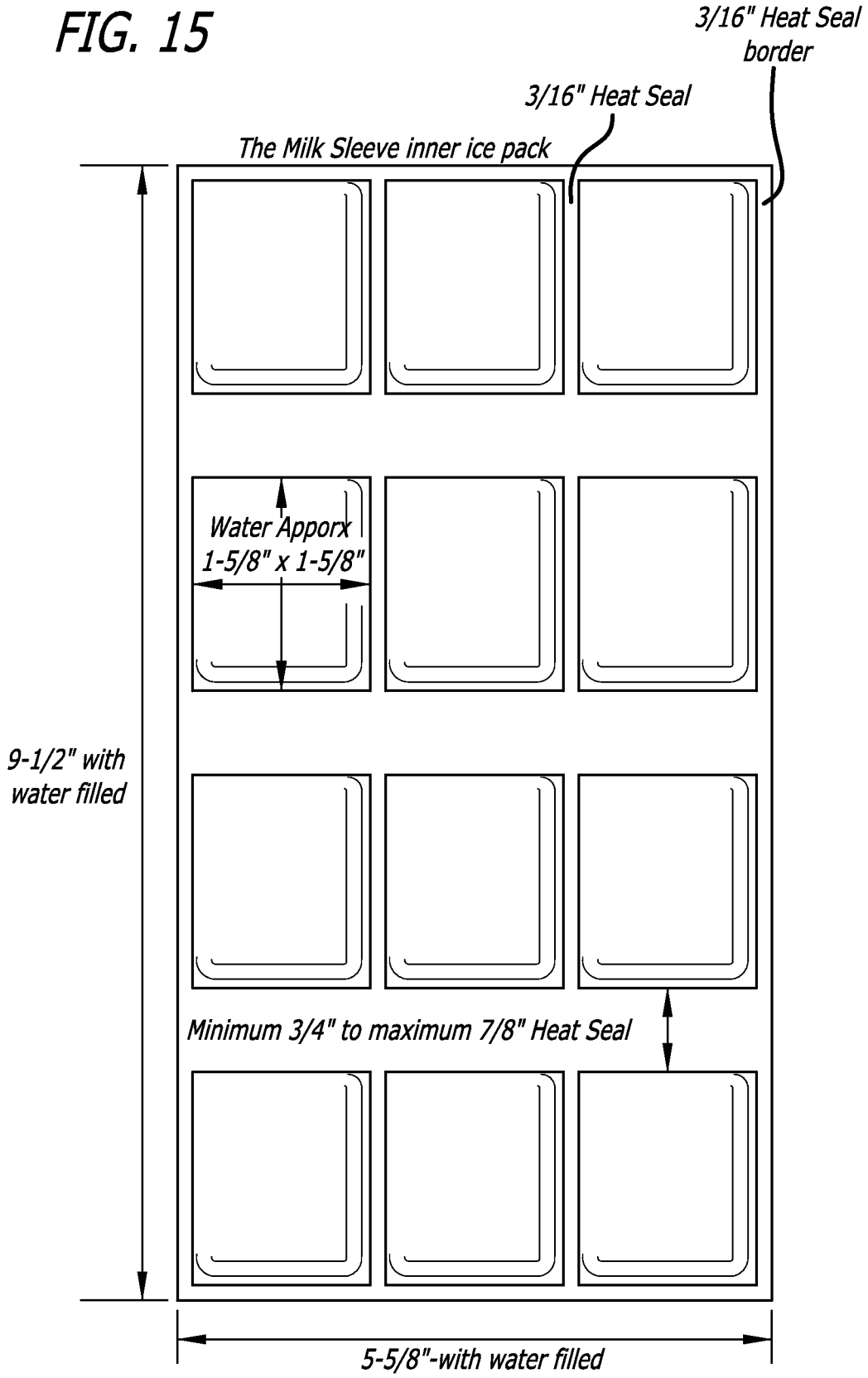
FIG. 15 is one example of a dimension ice pack of the present invention having at least four columns.

FIG. 15 illustrates an example layout of an ice pack of the present invention dimensioned for the prisma container, whether designed to be contained within a sleeve 400 or designed as part of the sleeve. As illustrated, in the offered example designed for use with prisma containers, the total length of the ice pack 300 may be approximately 9½" in length L and the height H is approximately 5⅝". The width of the segments 301 S are approximately 2⅜-½" and the columns widths C are approximately 1⅝" inches and separated from one another by a distance D of ¾" to ⅞". While the segments and columns are shown created by cubed segments separated by heat seal, the columns, as noted above may be separated by a seam, glue or other mechanism. Further, the columns may be made from cubed heat seal separated segments or a single column filled with a freezable substance, without any separation alone the column.

As noted above, the dimensions described below are for an ice pack for use in connection with prisma cartons 200, those skilled in the art will recognize that the dimensions may be scaled upward or downward to accommodate varying sized square objects. Additionally, when used in connection with a containment sleeve, the sleeve may be dimensioned to receive the ice pack, in which case, the dimensions of the sleeve may be, for example, approximately 10½"×5¾", which provides extra length for the inclusion of a fastening means. These dimensions may also translate to the ice pack having receptacles for receiving individual column shaped ice pouches. Further, while water is indicated as being used as the freezable material in FIG. 15, any freezable non-toxic substances such as gel, water, saline, beads, beans, corn, chemical substances other known refrigerants or substances commonly used in ice packs can be used without departing from the invention.

Further, it is recognized that while prisma containers are generally square in shape they do have cropped corners. The present invention, despite being described for use with square containers are intended for use with any generally square or rectangular containers without regard to whether the corners are rounded or cropped.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

It will be understood, and is appreciated that various aspects or details of the invention may be changed without departing from the scope of the invention. Furthermore, the foregoing description is for the purpose of illustration only, and not for the purpose of limitation—the invention being defined by the claims.

What is claimed is:

1. An ice pack for wrapping around prisma cartons to keep the contents of the prisma cartons cold, where the prisma cartons have four generally equal sized sides and four corners, where the ice pack is comprised of four generally equal sized columns of freezable liquid in adjacent parallel alignment with one another separated from one another by vertical heat seals having a length and width at a distance that will allow the ice pack to lie flat in a frozen state and that will also allow the four columns, when the ice pack is frozen, to bend toward one another and at least create right angles relative to one another in a manner that creates corners between the four columns for receiving the four corners of the corresponding prisma carton for which the ice pack is intended to maintain cold and for permitting direct contact of each of the four columns with one of the generally equal sized sides of the prisma carton, and where the four generally equal sized columns include two center columns and first and second opposing end columns, where a first hook and loop fastener strip having a length and width extends from the first opposing end column and a second hook and loop fastener strip having a length and width extends from a second opposing end column for attaching the first and second opposing end columns to one another at a point between the first and second opposing end columns, where both the length and width of the first and second hook and loop fasteners strips are substantially the same size as the length and width of each vertical heat seal such that the four generally equal sized columns of the ice pack, when attached together by the first and second hook and loop fastener strips, creates a contiguous square tube shape having an open top end and an open bottom end; and where the first and second hook and loop fastener strips, when attached together around the prisma carton, allow each of the four columns of the ice pack to maintain direct contact with each of the generally equal sized sides of the prisma carton.

2. The ice pack of claim 1 further including a containment sleeve for containing and covering the ice pack.

3. The ice pack of claim 1 where the distance between the columns is between ¾ to ⅞ of an inch.

4. The ice pack of claim 1 where the columns are approximately 1 and ⅝ inches wide.

5. The ice pack of claim 1 where the hook and loop fasteners when attached together creates a fifth side that is substantially smaller than the four generally equal sized sides, where the fifth side does not comprise of any freezable liquid.

* * * * *